US010533825B2

(12) United States Patent
Schrock

(10) Patent No.: US 10,533,825 B2
(45) Date of Patent: Jan. 14, 2020

(54) TRIGGER AND GRIP ARMOR SYSTEMS

(71) Applicant: Andy L. Schrock, Salt Lake City, UT (US)

(72) Inventor: Andy L. Schrock, Salt Lake City, UT (US)

( * ) Notice: Subject to any disclaimer, the term of this patent is extended or adjusted under 35 U.S.C. 154(b) by 0 days.

(21) Appl. No.: 15/920,072

(22) Filed: Mar. 13, 2018

(65) Prior Publication Data

US 2018/0259292 A1 Sep. 13, 2018

Related U.S. Application Data

(60) Provisional application No. 62/470,528, filed on Mar. 13, 2017.

(51) Int. Cl.
*F41C 23/10* (2006.01)
*F41C 7/00* (2006.01)
*F41C 23/18* (2006.01)

(52) U.S. Cl.
CPC ..... *F41C 23/10* (2013.01); *F41C 7/00* (2013.01); *F41C 23/18* (2013.01)

(58) Field of Classification Search
CPC .... F41H 5/12; F41H 5/14; F41C 23/10; F41C 23/18; F41C 27/04
USPC ..... 89/36.06, 36.02; 42/71.01
See application file for complete search history.

(56) References Cited

U.S. PATENT DOCUMENTS

| | | | | | |
|---|---|---|---|---|---|
| 2,215,204 | A * | 9/1940 | Young | F41A 9/54 | 89/33.14 |
| 4,944,109 | A * | 7/1990 | Zedrosser | F41C 23/00 | 42/71.01 |
| 7,155,857 | B2 * | 1/2007 | Elder | F41C 23/16 | 42/72 |
| 7,520,206 | B2 * | 4/2009 | Baker | F41H 5/08 | 89/36.05 |
| D684,649 | S * | 6/2013 | Mulcahey | D22/108 | |
| 2005/0011101 | A1 * | 1/2005 | Gooder | F41C 23/00 | 42/71.01 |
| 2006/0168868 | A1 * | 8/2006 | Phillips | F41C 23/06 | 42/71.01 |
| 2011/0030258 | A1 * | 2/2011 | Fistikchi | F41C 23/12 | 42/1.06 |
| 2011/0185617 | A1 * | 8/2011 | Brixius | F41C 23/12 | 42/71.01 |
| 2012/0131829 | A1 * | 5/2012 | Fistikchi | F41A 3/72 | 42/1.06 |
| 2013/0213209 | A1 * | 8/2013 | Mulcahey | F41H 1/00 | 89/36.02 |
| 2015/0219421 | A1 * | 8/2015 | Zamlinsky | F41C 23/20 | 42/71.01 |

* cited by examiner

*Primary Examiner* — John Cooper
(74) *Attorney, Agent, or Firm* — Stoel Rives LLP

(57) ABSTRACT

Trigger armor systems and grip armor systems are provided. The trigger armor system may include an integral finger rest, grip, and knuckle guard. The grip armor system may include an integral angle grip and well grip. Trigger and grip armor systems including an integral trigger armor system and grip armor system are also provided.

11 Claims, 12 Drawing Sheets

TRIGGER AND GRIP ARMOR SYSTEMS

CROSS-REFERENCE TO RELATED APPLICATION

This application claims the benefit of U.S. Provisional Patent Application No. 62/470,528, filed Mar. 13, 2017, which is hereby incorporated by reference in its entirety.

TECHNICAL FIELD

The present disclosure relates generally to accessories for firearms. More specifically, the present disclosure relates to trigger armor systems. Further, the present disclosure relates to grip armor systems.

BRIEF DESCRIPTION OF THE DRAWINGS

The embodiments disclosed herein will become more fully apparent from the following description and appended claims, taken in conjunction with the accompanying drawings. While various aspects of the embodiments are presented in drawings, the drawings depict only typical embodiments, which will be described with additional specificity and detail through use of the accompanying drawings in which:

DETAILED DESCRIPTION

Figure 1:
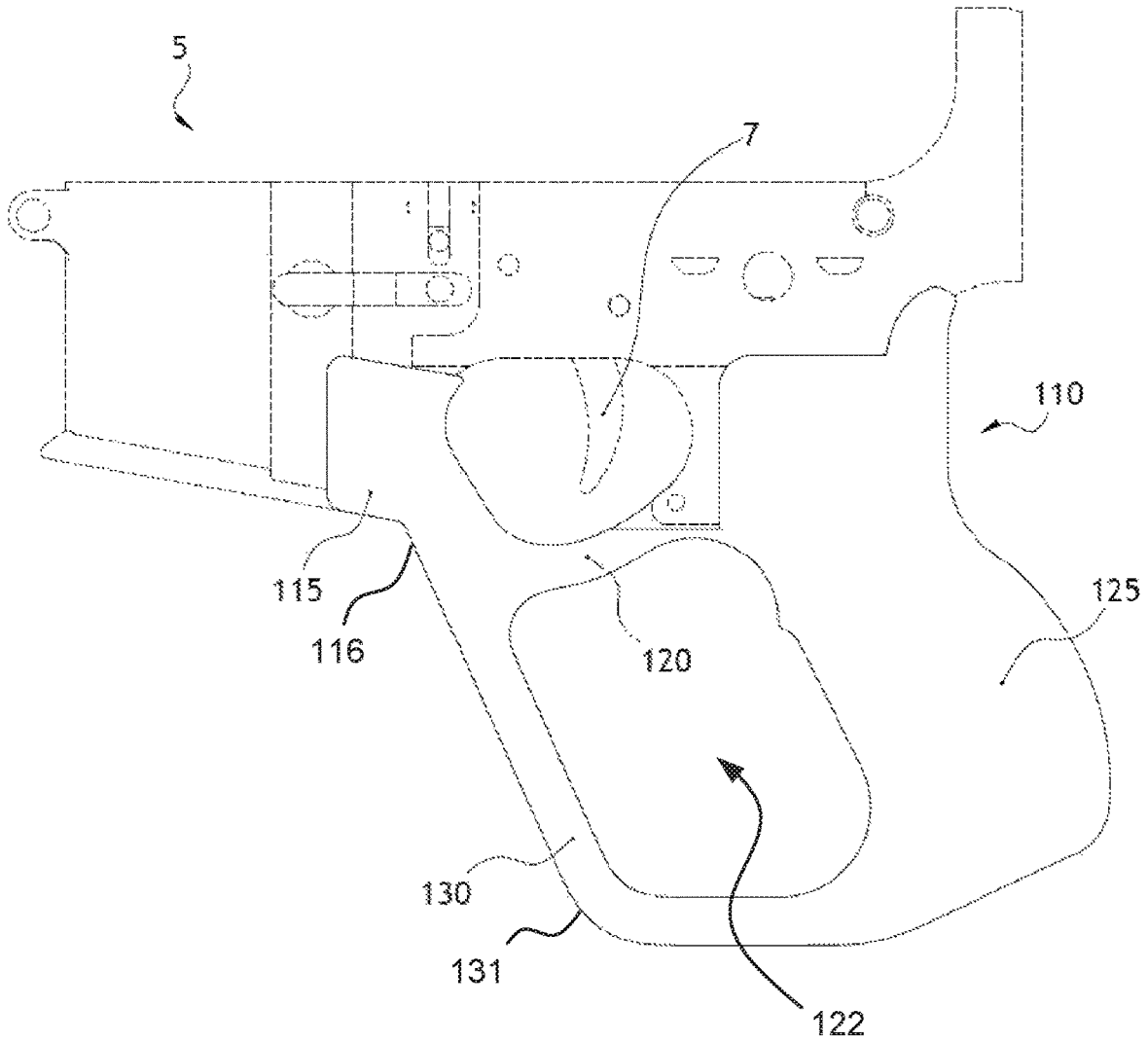
FIG. 1 is a first side view of an embodiment of a trigger armor system.

The various embodiments disclosed herein generally relate to trigger armor systems and grip armor systems. In some embodiments, the trigger armor system includes an integral finger rest, grip, and knuckle guard. In certain embodiments, the grip armor system includes an integral angle grip and well grip. Trigger and grip armor systems including an integral trigger armor system and grip armor system are also provided.

It will be appreciated that various features are sometimes grouped together in a single embodiment, figure, or description thereof for the purpose of streamlining the disclosure. Many of these features may be used alone and/or in combination with one another.

Embodiments may be understood by reference to the drawings, wherein like parts are designated by like numerals throughout. It will be readily understood that the components of the present disclosure, as generally described and illustrated in the drawings herein, could be arranged and designed in a wide variety of different configurations. Thus, the following more detailed description of the embodiments of the apparatus is not intended to limit the scope of the disclosure, but is merely representative of possible embodiments of the disclosure. In some cases, well-known structures, materials, or operations are not shown or described in detail. While the various aspects of the embodiments are presented in drawings, the drawings are not necessarily drawn to scale unless specifically indicated.

The phrase "coupled to" refers to any form of interaction between two or more entities, including but not limited to mechanical, electrical, magnetic, electromagnetic, fluid, and thermal interaction. Two components may be coupled to each other even though they are not in direct contact with each other. For example, two components may be coupled to each other through an intermediate component.

The terms "forward" and "rearward" refer to opposite ends of a firearm. As used herein, the forward portion of a firearm accessory is the portion nearest a barrel and/or a muzzle of the firearm when the firearm accessory is coupled to the firearm, while the rearward portion of the firearm accessory is a portion at the opposite end. For example, the rearward portion of a firearm accessory is defined as the portion closest to the stock of the firearm when the firearm accessory is coupled to the firearm. The forward end is the end opposite the rearward end.

The term "longitudinal axis" refers to an axis extending between a forward end and a rearward end of a firearm. For example, the longitudinal axis of a rifle is an axis extending between a forward end of the barrel of the rifle and a rearward end of the stock of the rifle.

Accessories can be attached or coupled to a firearm such as a rifle. For example, grips, trigger guards, and/or finger rests may be coupled to a rifle. Generally, such accessories can be coupled individually to a rifle or the accessories can be combined in pairs (e.g., a grip and trigger guard combination, or a trigger guard and finger rest combination). Such pairs can be coupled in combination to a rifle. For example, the trigger armor systems and the grip armor systems provided herein can be coupled to a military specification AR-15 or M16 rifle. In some embodiments, the trigger armor systems and the grip armor systems provided herein can replace a stock grip (e.g., a standard grip that is supplied with the rifle).

Figure 2:
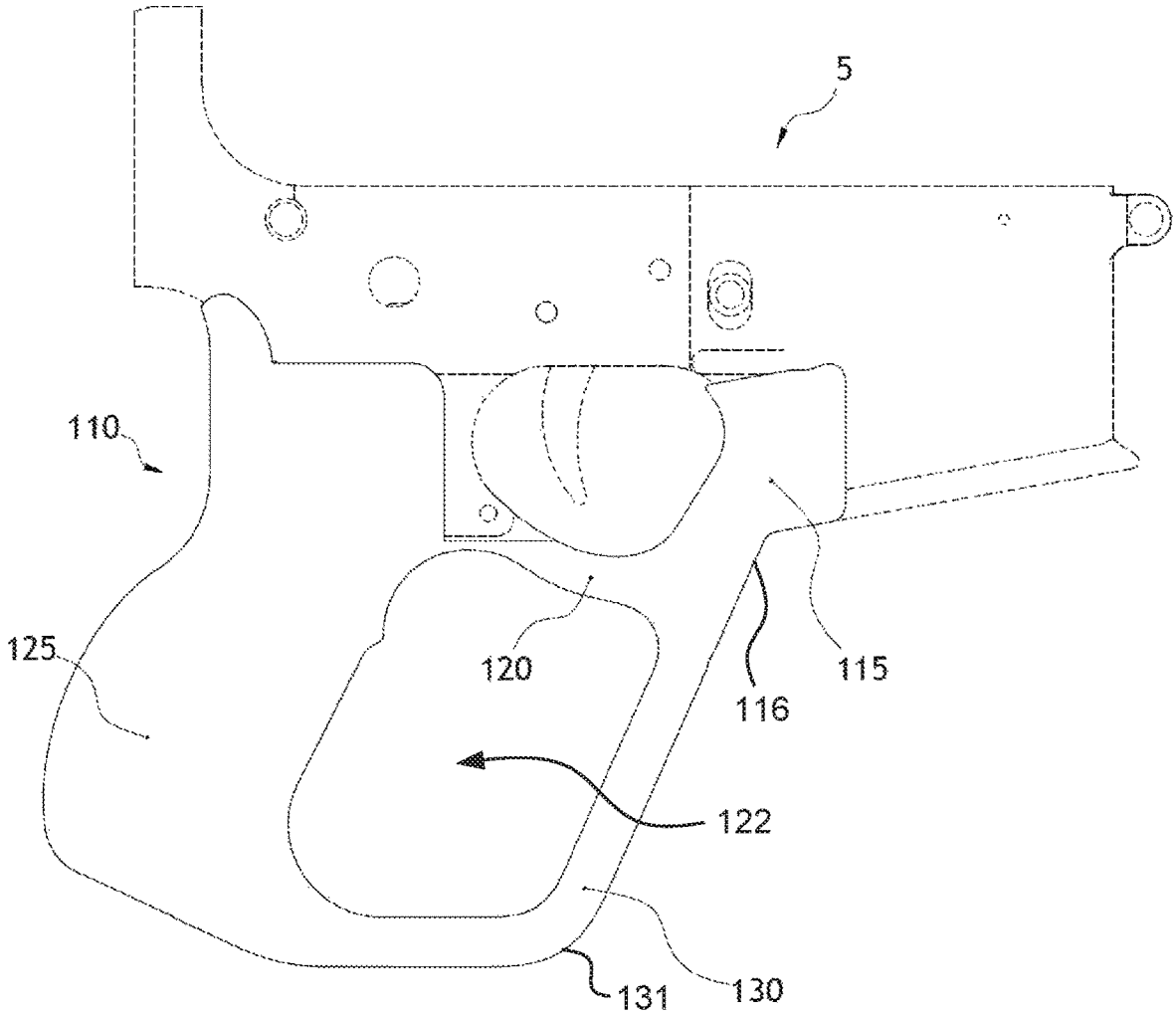
FIG. 2 is a second side view of the trigger armor system of FIG. 1.
Figure 3:
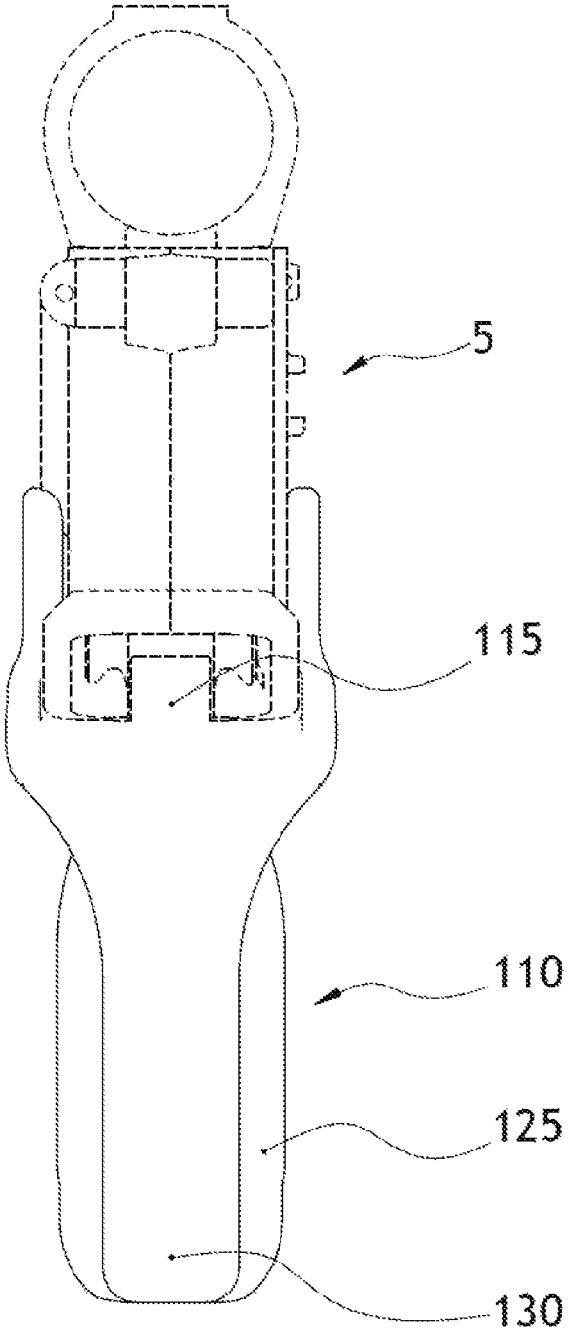
FIG. 3 is a front view of the trigger armor system of FIG. 1.
Figure 4:
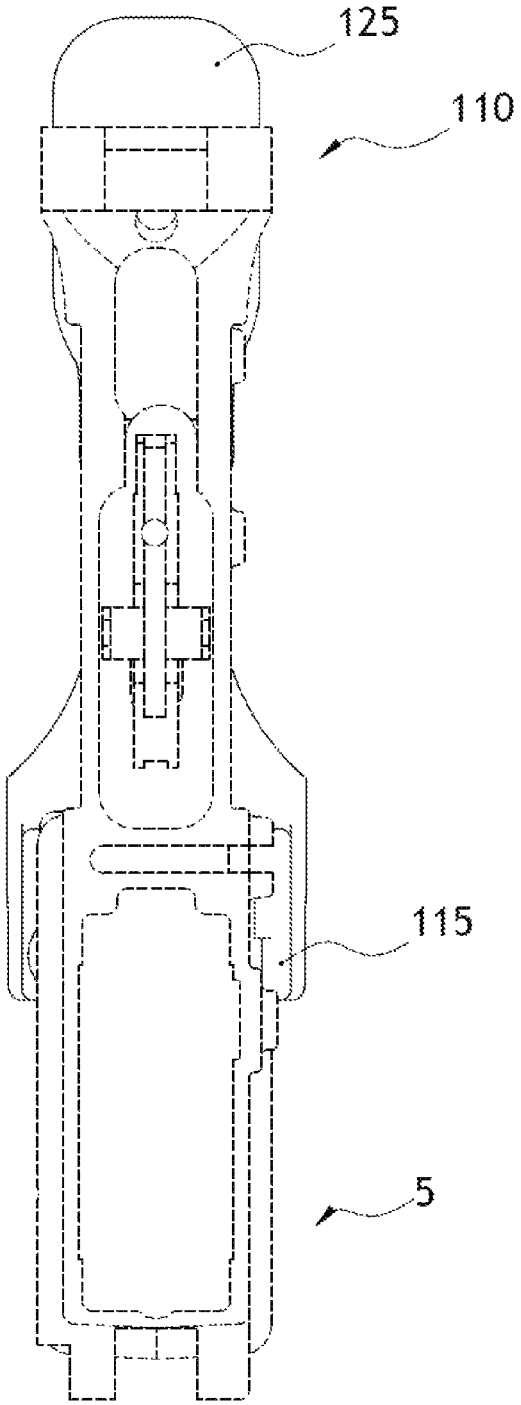
FIG. 4 is a top view of the trigger armor system of FIG. 1.
Figure 5:
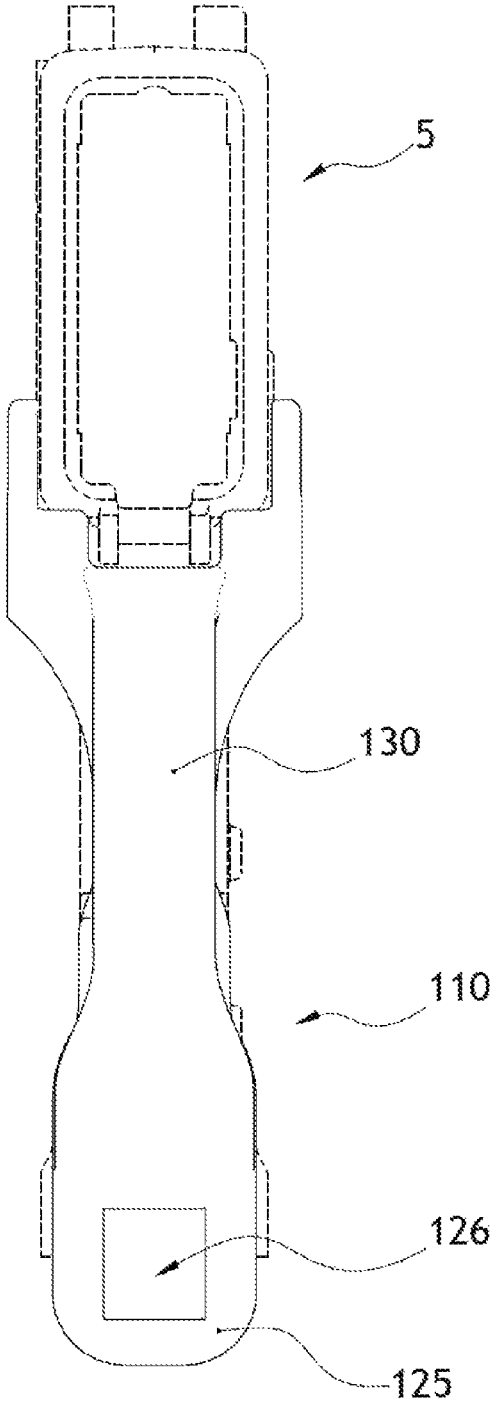
FIG. 5 is a bottom view of the trigger armor system of FIG. 1.
Figure 6:
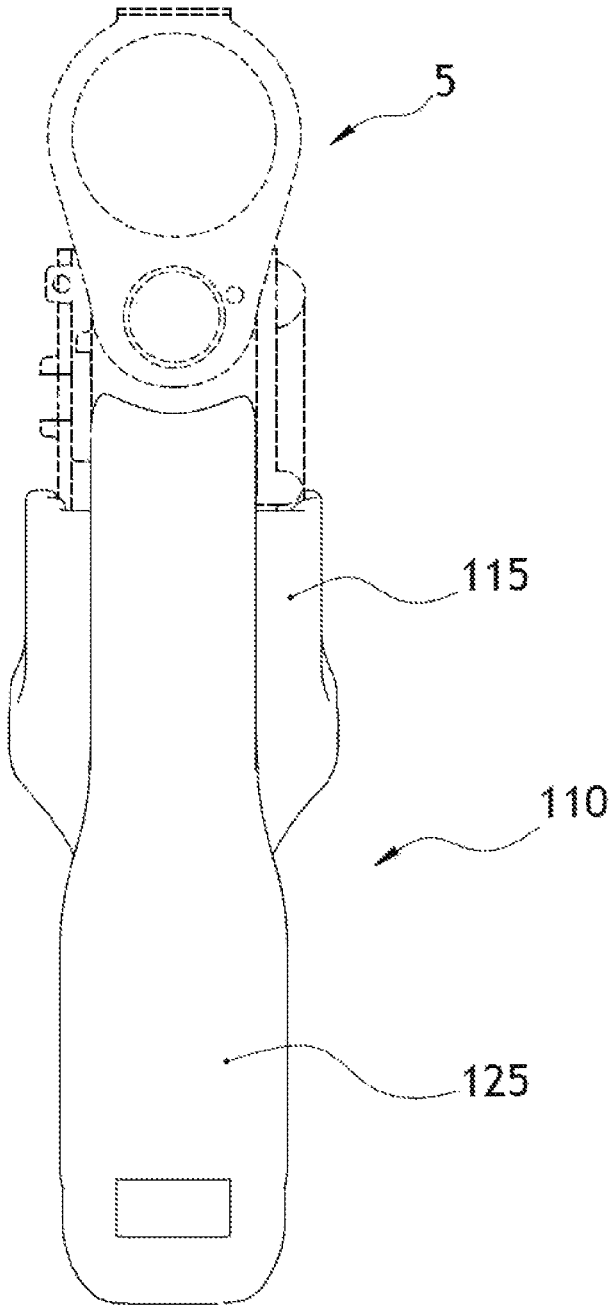
FIG. 6 is a rear view of the trigger armor system of FIG. 1.
Figure 7:
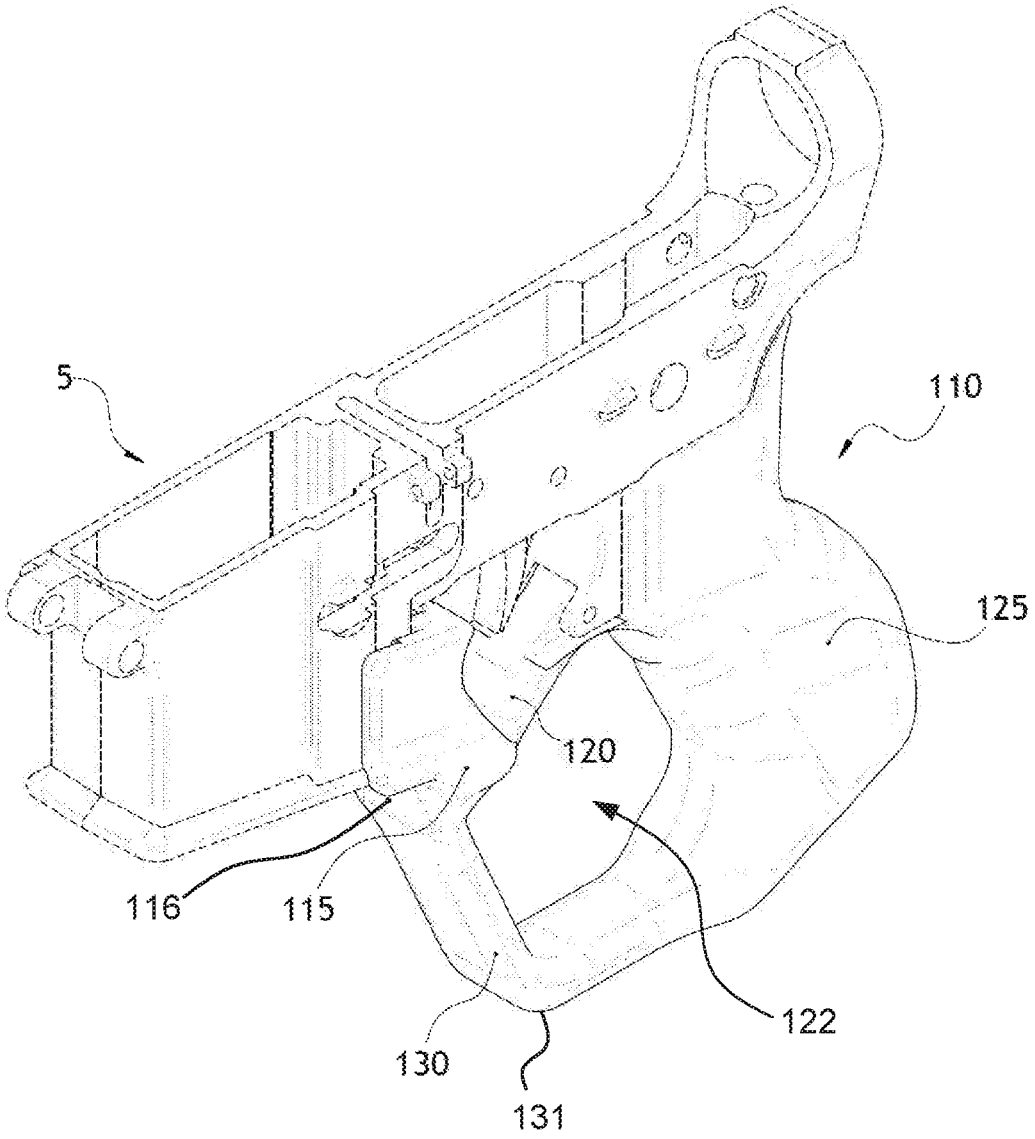
FIG. 7 is a front perspective view of the trigger armor system of FIG. 1.
Figure 8:
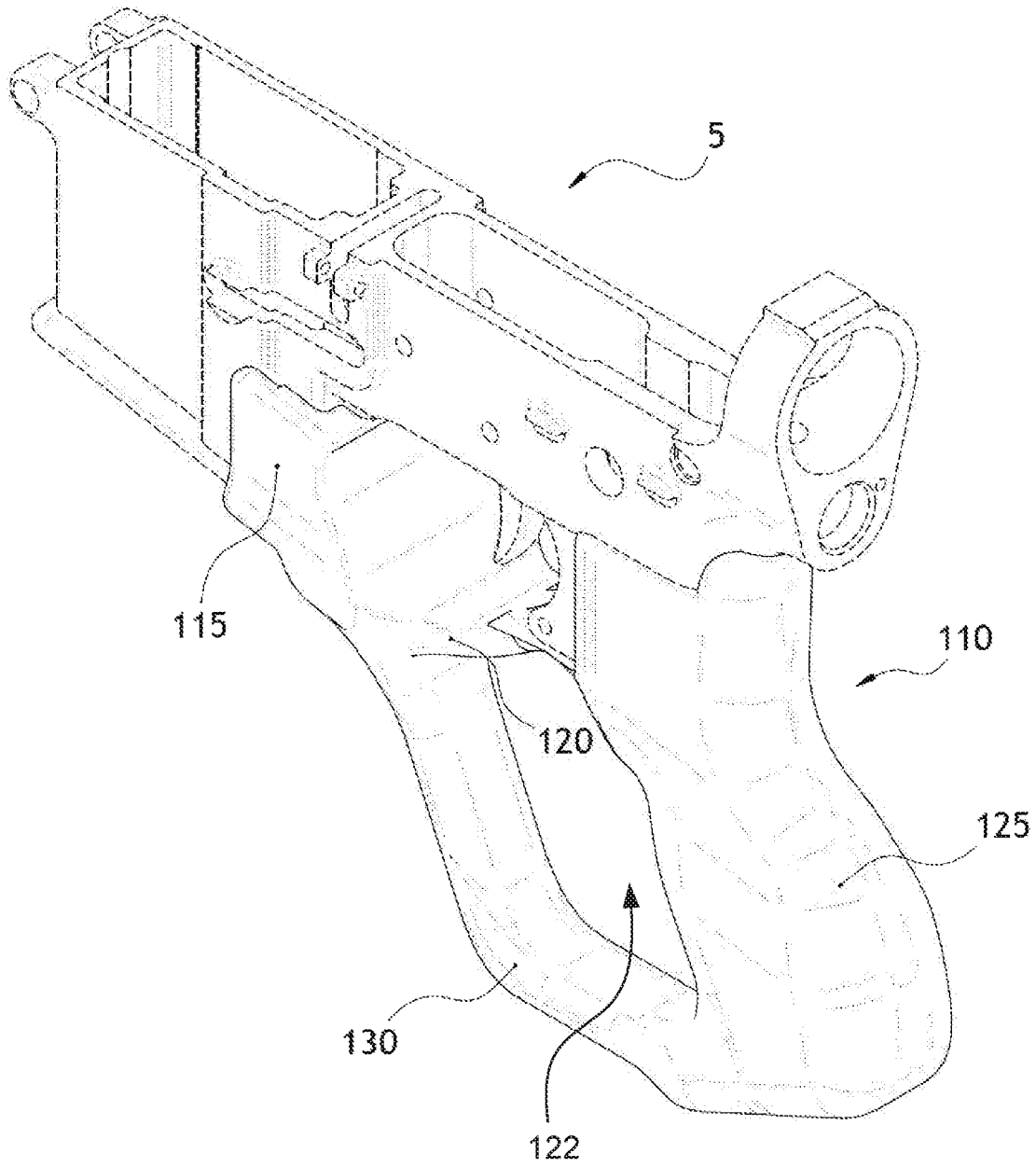
FIG. 8 is a rear perspective view of the trigger armor system of FIG. 1.
Figure 9:
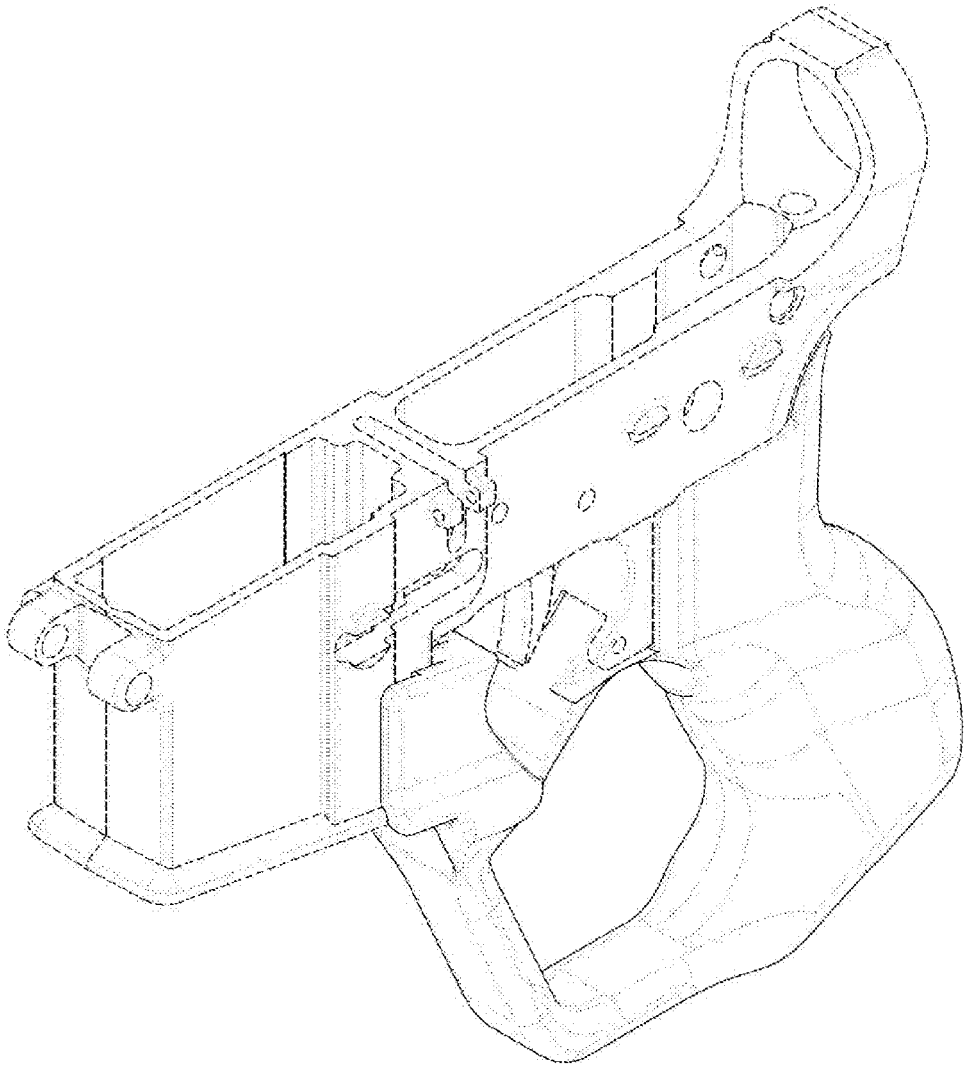
FIG. 9 is a detailed front perspective view of the trigger armor system of FIG. 1.
Figure 10:
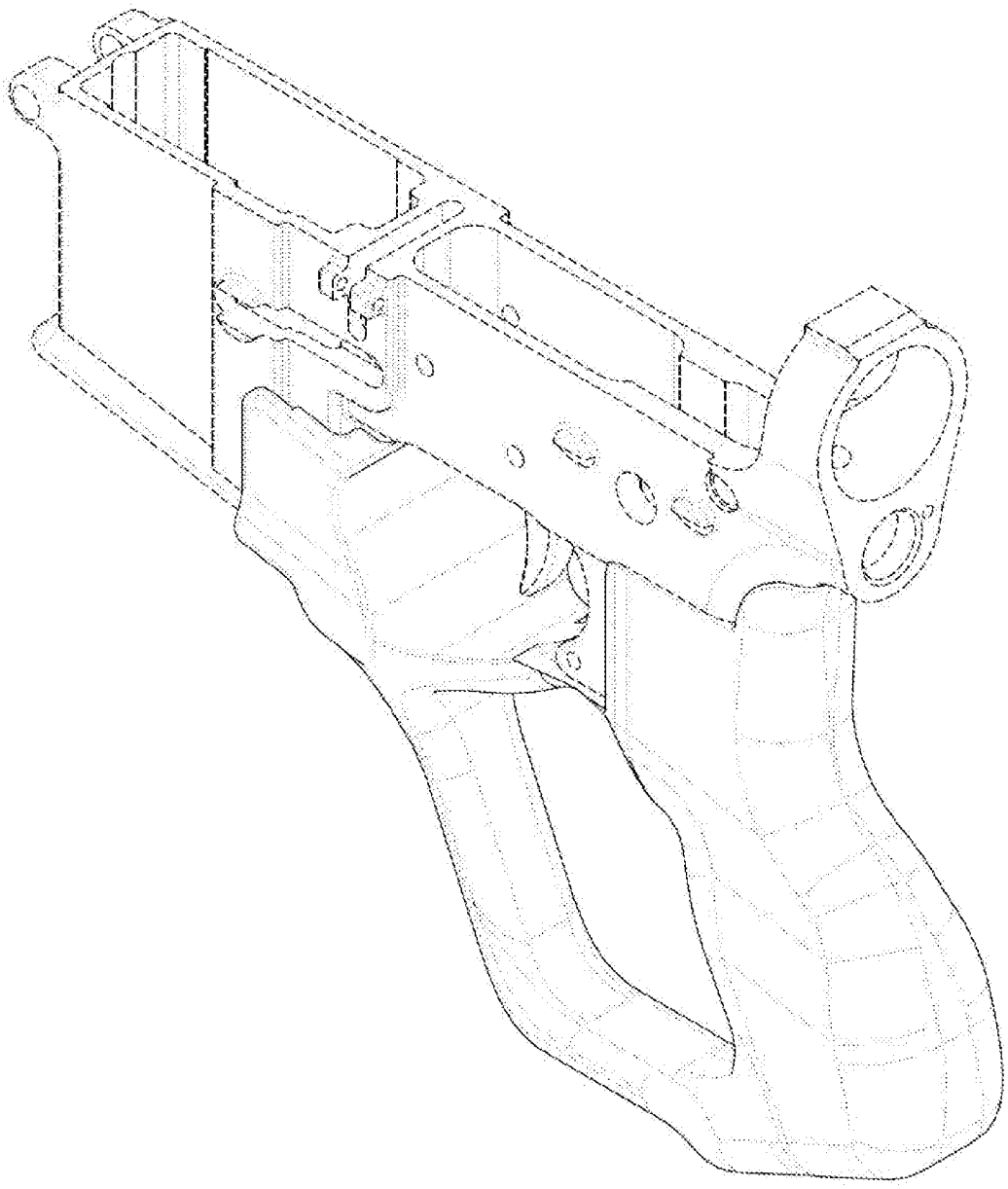
FIG. 10 is a detailed rear perspective view of the trigger armor system of FIG. 1.

FIG. 1 is a first side view of a trigger armor system 110 (also referred to as a trigger guard and finger rest combination) coupled to at least a portion of a rifle 5. FIGS. 2-10 depict additional views of the trigger armor system 110 coupled to the rifle 5. Specifically, FIG. 2 is a second side view, FIG. 3 is a front view, FIG. 4 is a top view, FIG. 5 is a bottom view, and FIG. 6 is a rear view. FIG. 7 is a front perspective view, FIG. 8 is a rear perspective view, FIG. 9 is a detailed front perspective view, and FIG. 10 is a detailed rear perspective view of the trigger armor system 110.

The trigger armor system 110 can include a finger rest 115, a trigger guard 120, a grip 125, and/or a knuckle guard 130. In some embodiments, the trigger armor system 110 can be a single accessory or attachment. For example, each of the finger rest 115, the trigger guard 120, the grip 125, and the knuckle guard 130 may be integral with each other.

Stated another way, each of the finger rest 115, the trigger guard 120, the grip 125, and the knuckle guard 130 may be formed as a single unit.

In some embodiments, the trigger armor system 110 may be coupleable, or removeably coupleable, to a firearm, such as the rifle 5. The trigger armor system 110 may be coupleable to the rifle 5 via a snap-fit mechanism, a fastener (e.g., a screw), or any other suitable coupling device. In some embodiments, the trigger armor system 110 can be coupled or secured to a lower zone of a rifle via a bolt (e.g., a single bolt). The bolt may be disposed through a hollow core 126 (see, e.g., FIG. 5) of the grip 125. The trigger armor system 110 may be configured such that a user may couple and/or uncouple the trigger armor system 110 from a suitable firearm. In certain embodiments, the trigger armor system 110 may be configured to replace a standard or stock grip that is supplied with the rifle 5.

As shown in FIGS. 1-10, the finger rest 115 can be disposed adjacent or toward a forward portion of the trigger armor system 110. During use of the rifle 5, one or more of a user's fingers may rest against at least a portion of an external surface 116 of the finger rest 115. Disposition of the one or more fingers on the finger rest 115 may assist the user in stabilizing and/or controlling the rifle 5, for example, during use of the rifle 5.

The trigger guard 120 can extend rearward from at least a portion of the finger rest 115 and can extend around at least a portion of a perimeter of a trigger 7 of the rifle 5. Stated another way, the trigger guard 120 may form at least a portion of a loop around the trigger 7. In certain embodiments, the trigger guard 120 may be configured to inhibit or prevent accidental discharge of the rifle 5. For example, the trigger guard 120 may limit or prevent contact between the trigger 7 and another surface (e.g., the ground).

The grip 125 may form a rearward portion of the trigger armor system 110. In various embodiments, the grip 125 may be configured to be grasped by at least a portion of a user's hand. The grip 125, when coupled to the rifle 5, may extend away from the rifle 5 (e.g., downward from the rifle 5). Furthermore, as shown, in some embodiments, the grip 125 may extend rearward and away from the rifle 5, when coupled to the rifle 5 (e.g., at an angle relative to the longitudinal axis of the rifle 5). The trigger guard 120 can extend between the finger rest 115 and the grip 125. As shown, the trigger guard 120 can extend between a lower portion of the finger rest 115 and an upper portion of the grip 125. As used herein, directional terms, such as "downward," "upper," "lower," etc., are used with respect to the orientation shown in FIGS. 1-12. However, such terms are used for the sake of convenience and are not intended to be limiting. For example, it will be understood that an upper portion could be referred to as a first portion, and a lower portion could be referred to as a second portion, etc.

With continued reference to FIGS. 1-10, the knuckle guard 130 can extend away (e.g., downward) from the finger rest 115 along a forward portion of the trigger armor system 110 to a curved portion 131. For example, as shown, a forward portion of the knuckle guard 130 may extend rearward and away from the rifle 5, when coupled to the rifle 5 (e.g., at an angle relative to the longitudinal axis of the rifle 5). At the curved portion 131, the knuckle guard 130 can extend rearward toward a lower portion of the grip 125. The knuckle guard 130 may be configured to protect at least a portion of the user's fingers (e.g., the knuckles) during use of the rifle 5. Furthermore, an aperture 122 may be disposed through a central portion of the trigger armor system 110. For example, the aperture 122 may be disposed between a portion of each of the trigger guard 120, the grip 125, and the knuckle guard 130. When the user grasps the trigger armor system 110, at least a portion of one or more of the user's fingers may extend through the aperture 122.

As illustrated, the trigger armor system 110 is a single or unitary component. In other words, the trigger armor system 110 includes the finger rest 115, the trigger guard 120, and the grip 125, wherein the finger rest 115, the trigger guard 120, and the grip 125 are integral with each other. Such a configuration can enhance the stability and/or the visual aesthetics of the trigger armor system 110. In some embodiments, the knuckle guard 130 may enhance the stability and/or the visual aesthetics of the trigger armor system 110 in comparison to a trigger armor system lacking a knuckle guard. The unitary or integral configuration of the trigger armor system 110 can also prevent damage to at least a portion of the rifle 5, for example, if the rifle 5 is dropped. Furthermore, in contrast to individual or separate finger rests, trigger guards, and/or grips, a unitary or integral trigger armor system 110, as provided herein, can ease or simplify the coupling of the trigger armor system 110 to the rifle 5. Stated another way, the trigger armor system 110 may be easier to couple to the rifle 5 than a discrete finger rest, a discrete trigger guard, and/or a discrete grip.

The trigger armor system 110 may be formed from a polymer, a polymer fiber, a metal, or any other suitable material. For example, the finger rest 115, the trigger guard 120, the grip 125, and the knuckle guard 130 may be formed from a single piece of material. In some embodiments, a length of the trigger armor system 110 may be between about 9 inches and about 3 inches, between about 8 inches and about 4 inches, between about 7 inches and about 5 inches, about 6 inches, or any other suitable length. In certain embodiments, a height of the trigger armor system 110 may be between about 8 inches and about 2 inches, between about 7 inches and about 3 inches, between about 6 inches and about 4 inches, about 5 inches, or any other suitable height.

The edges or ends of the trigger armor system 110, and/or its components (e.g., the finger rest 115, the trigger guard 120, the grip 125, and the knuckle guard 130), may be rounded and/or smooth (see, e.g., FIGS. 7-10). For example, the configuration of the trigger armor system 110 may be ergonomic such that the trigger armor system 110 is configured to be comfortably, easily, and/or safely grasped by a user.

Figure 11:
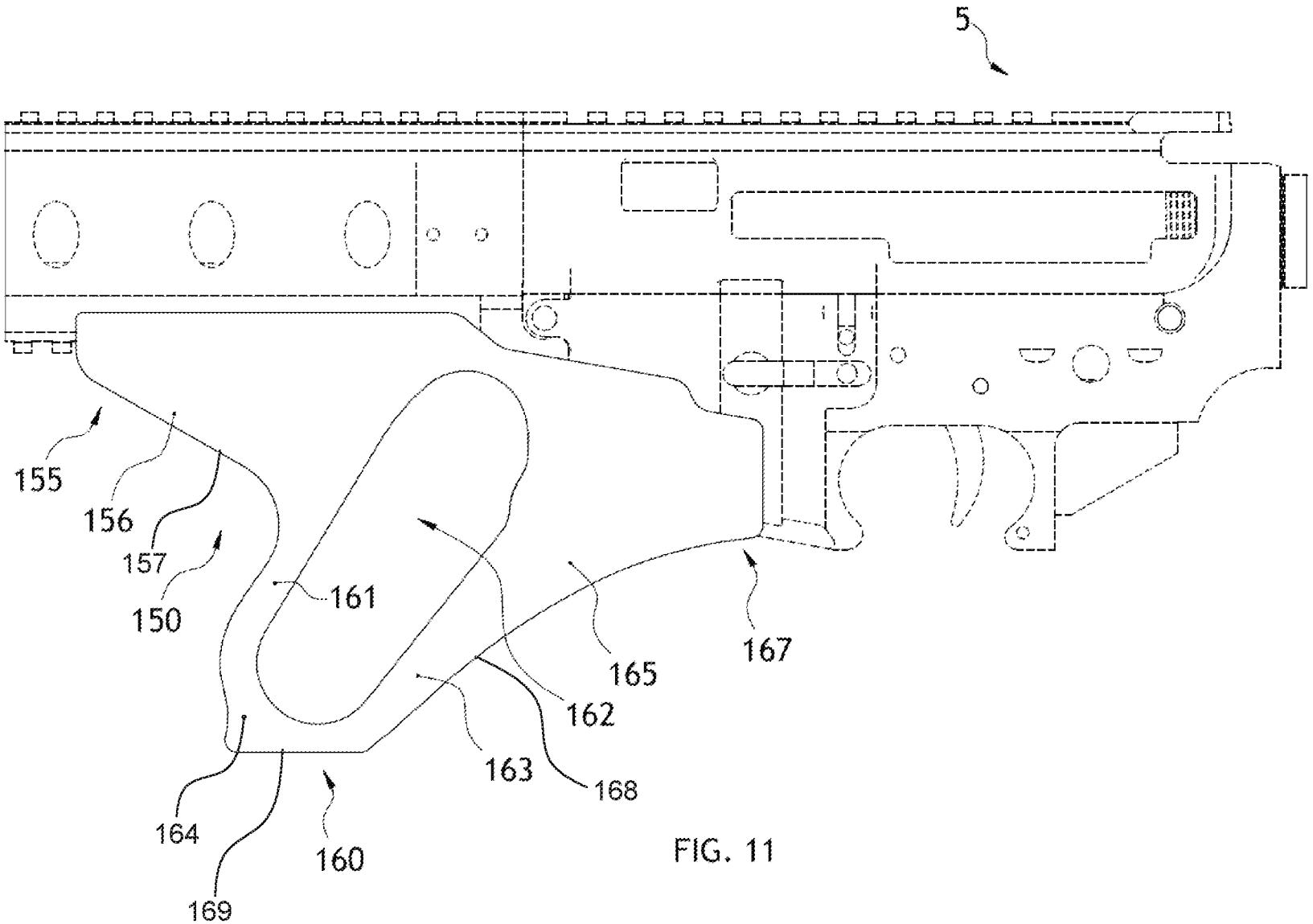
FIG. 11 is a side view of a grip armor system.

FIG. 11 is a side view of a grip armor system 150 (also referred to as an angle grip and well grip combination) coupled to at least a portion of the rifle 5. As shown, the grip armor system 150 can include an angled forward grip or angle grip 155 and/or a well grip 160. The grip armor system 150 can be a single accessory or attachment. For example, each of the angle grip 155 and the well grip 160 may be integral with each other. Stated another way, each of the angle grip 155 and the well grip 160 may be formed as a single unit.

In some embodiments, the grip armor system 150 may be coupleable, or removeably coupleable, to a firearm, such as the rifle 5. The grip armor system 150 may be coupleable to the rifle 5 via a snap-fit mechanism, a fastener (e.g., a screw), or any other suitable coupling device. The grip armor system 150 may be configured such that a user may couple and/or uncouple the grip armor system 150 from a suitable firearm.

As shown in FIG. 11, the angle grip 155 can be disposed adjacent or toward a forward portion of the grip armor system 150. During use of the rifle 5, at least a portion of a user's forward hand (or "off" hand) may grasp at least a portion of an external surface 156 of the angle grip 155. Disposition of at least a portion of a user's forward hand on the angle grip 155 may assist the user in stabilizing, controlling, and/or maneuvering the rifle 5, for example, during use of the rifle 5.

A forward end 157 of the angle grip 155 can extend downward and rearward from a portion of a lower zone of the rifle 5 toward the well grip 160 (e.g., at an angle relative to the longitudinal axis of the rifle 5). As illustrated, the angle grip 155 meets a forward portion 161 of the well grip 160 at a midpoint of the forward portion 161. The well grip 160 can include an aperture 162 disposed through a central portion of the well grip 160. In some embodiments, the well grip 160 may be grasped by disposing at least a portion of a user's hand through the aperture 162 and by wrapping at least a portion of the user's fingers around a rearward portion 163 of the well grip 160. Stated another way, the aperture 162 may be configured to receive at least a portion of the user's hand.

A lower portion 164 of the well grip 160 may extend between the forward portion 161 and the rearward portion 163 (e.g., at a position below the aperture 162). A lower end 169 of the lower portion 164 may be substantially linear or flat as shown. For example, the lower end 169 may be substantially parallel with the longitudinal axis of the rifle 5. In some other embodiments, the lower end 169 may be curved or otherwise shaped. During use, at least a portion of the user's hand may be disposed adjacent an external surface 165 of the well grip 160. Furthermore, a rearward end 168 of the well grip 160 at the rearward portion 163 may extend rearward and upward (e.g., along an arc) from the lower portion 164 toward a back end portion 167 of the well grip 160. The well grip 160 can be configured to prevent at least a portion of the user's hand from contacting or interfering with a magazine or a magazine well of the rifle 5.

As illustrated, the grip armor system 150 is a single or unitary component. In other words, the grip armor system 150 includes the angle grip 155 and the well grip 160, wherein the angle grip 155 and the well grip 160 are integral with each other. Such a configuration can enhance the stability and/or the visual aesthetics of the grip armor system 150. The unitary or integral configuration of the grip armor system 150 can also prevent damage to at least a portion of the rifle 5, for example, if the rifle 5 is dropped. In contrast to individual or separate angle grips and/or well grips, a unitary or integral grip armor system 150 as provided herein can ease or simplify the coupling of the grip armor system 150 to the rifle 5. Stated another way, the grip armor system 150 may be easier to couple to the rifle 5 than a discrete angle grip and/or a discrete well grip. Furthermore, a unitary or integral grip armor system 150 as provided herein can be smaller or take up less space than an individual or separate angle grip and well grip. For example, the grip armor system 150 may be coupleable to a Picatinny rail and the grip armor system 150 may save space on the Picatinny rail in comparison to individual or separate angle and well grips. In various embodiments, the grip armor system 150 may be coupleable, or removeably coupleable, to a standard Picatinny rail.

The grip armor system 150 may be formed from a polymer, a polymer fiber, a metal, or another suitable material. For example, the angle grip 155 and the well grip 160 may be formed from a single piece of material. In some embodiments, a length of the grip armor system 150 may be between about 9 inches and about 3 inches, between about 8 inches and about 4 inches, between about 7 inches and about 5 inches, about 6 inches, or any other suitable length. In certain embodiments, a height of the grip armor system 150 may be between about 8 inches and about 2 inches, between about 7 inches and about 3 inches, between about 6 inches and about 4 inches, about 5 inches, or any other suitable height.

As stated above regarding the trigger armor system 110, the edges or ends of the grip armor system 150, and/or its components (e.g., the angle grip 155 and the well grip 160), may be rounded and/or smooth. For example, the configuration of the grip armor system 150 may be ergonomic such that the grip armor system 150 is configured to be comfortably, easily, and/or safely grasped by a user.

Figure 12:
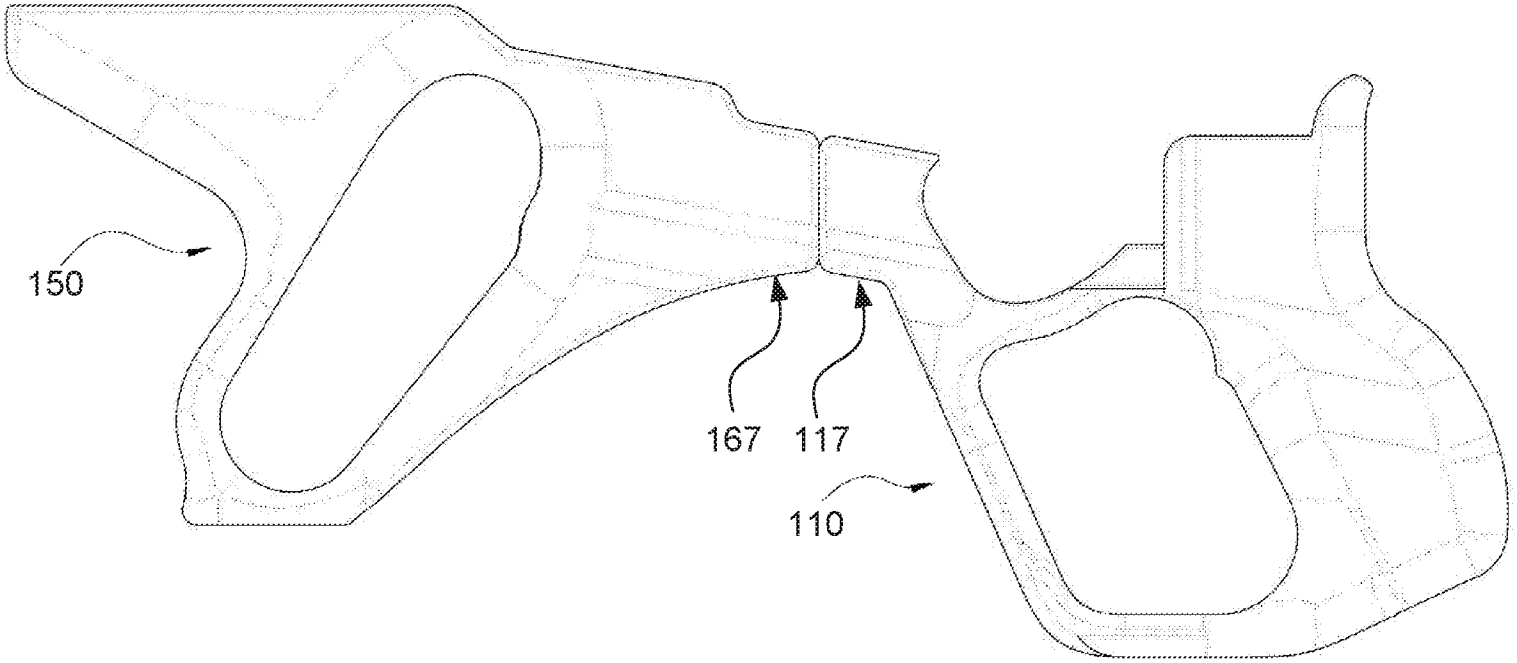
FIG. 12 is a side view of a combination of the trigger armor system of FIG. 1 and the grip armor system of FIG. 11.

FIG. 12 depicts the trigger armor system 110 and the grip armor system 150. As illustrated, the trigger armor system 110 may be configured to be disposed adjacent the grip armor system 150, or vice versa. The back end portion 167 of the grip armor system 150 may be shaped or otherwise configured to be disposed adjacent a front end portion 117 of the trigger armor system 110. As shown, the back end portion 167 may be disposed substantially flush with the front end portion 117 when the trigger armor system 110 and the grip armor system 150 are coupled to a rifle. For example, a user may simultaneously couple both the trigger armor system 110 and the grip armor system 150 to a rifle (not shown).

In some embodiments, a trigger armor system (analogous to the trigger armor system 110) may be integral with a grip armor system (analogous to the grip armor system 150). Stated another way, the trigger armor system 110 and the grip armor system 150 may be a single component. For example, the trigger armor system 110 and the grip armor system 150 may be formed from a single piece of material.

Methods are also contemplated in connection with the devices disclosed above. Disclosure recited in connection with any device herein may be analogously applied to any method. In other words, any of the processes, steps, or functions described in connection with the devices above may be analogously incorporated into methods within the scope of this disclosure. An exemplary method relating to the devices discussed above may comprise a method of coupling a trigger armor system and/or a grip armor system to a rifle.

References to approximations are made throughout this specification, such as by use of the term "substantially." For each such reference, it is to be understood that, in some embodiments, the value, feature, or characteristic may be specified without approximation. For example, where qualifiers such as "about" and "substantially" are used, these terms include within their scope the qualified words in the absence of their qualifiers. For example, where the term "substantially parallel" is recited with respect to a feature, it is understood that in further embodiments, the feature can have a precisely parallel configuration.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

The invention claimed is:

1. A trigger and grip armor system comprising:

a trigger armor system comprising:

a finger rest;

a grip; and a knuckle guard; and a grip armor system comprising:

an angle grip; and a well grip, wherein the angle grip is disposed adjacent a forward portion of the grip armor system, and wherein the well grip is disposed adjacent a rearward portion of the grip armor system, wherein the well grip comprises an aperture disposed through a central portion of the well grip between a forward portion and a rearward portion of the well grip, and the aperture is angled and extends upward and rearward from a forward end of the well grip, wherein a forward end of the angle grip is angled and extends downward and rearward toward a midpoint of the aperture of the well grip, wherein a lower portion of the well grip extends between the forward portion and the rearward portion at a position below the aperture, and wherein the trigger and grip armor system is configured to couple to an AR-15 or an M16.

2. The trigger and grip armor system of claim 1, wherein the grip armor system is disposed adjacent a forward portion of the trigger and grip armor system, and wherein the trigger armor system is disposed adjacent a rearward portion of the trigger and grip armor system.

3. The trigger and grip armor system of claim 1, wherein the trigger and grip armor system is formed from at least one of a polymer, a polymer fiber, and a metal.

4. The trigger and grip armor system of claim 1, wherein the trigger armor system and the grip armor system are removeably coupleable to a rifle.

5. The trigger and grip armor system of claim 1, wherein the finger rest is disposed adjacent a forward portion of the trigger armor system.

6. The trigger and grip armor system of claim 5, wherein a trigger guard extends rearward from the finger rest, and wherein the trigger guard is configured to extend around a portion of a trigger of a rifle when the trigger armor system is coupled to the rifle.

7. The trigger and grip armor system of claim 6, wherein the grip is disposed adjacent a rearward portion of the trigger armor system, and wherein the trigger guard extends between the finger rest and the grip.

8. The trigger and grip armor system of claim 7, wherein the knuckle guard extends from the finger rest along the forward portion of the trigger armor system, and wherein the knuckle guard comprises a curved portion such that the knuckle guard extends rearward to a lower portion of the grip.

9. The trigger and grip armor system of claim 1, wherein a rearward end of the rearward portion extends rearward and upward from the lower portion toward a back end portion of the well grip.

10. The trigger and grip armor system of claim 1, wherein the angle of the angled grip is substantially perpendicular with the angle of the aperture.

11. The trigger and grip armor system of claim 1, wherein the trigger armor system and the grip armor system are integral with each other.

* * * * *